United States Patent [19]

Bernstein et al.

[11] 3,969,791

[45] July 20, 1976

[54] BUTTON AND RETAINER

[76] Inventors: Alvin H. Bernstein, 221 Countryside Lane, Mount Laurel, N.J. 08054; Domenic J. Santulli, 344 S. 18th St., Philadelphia, Pa. 19103

[22] Filed: Apr. 14, 1975

[21] Appl. No.: 568,213

[52] U.S. Cl. ..... 24/56

[51] Int. Cl.[2] ..... E05F 3/04

[58] Field of Search ..... 24/49 KC, 49 CF, 61, 24/62, 64, 65, 101 B, 101 R, 56

[56] References Cited

UNITED STATES PATENTS

| | | | |
|---|---|---|---|
| 1,567,247 | 12/1925 | Croson | 24/101 B |
| 1,593,061 | 7/1926 | Collins | 24/56 |
| 1,984,640 | 12/1934 | Grotewold | 24/61 X |
| 2,248,939 | 7/1941 | Benson | 24/56 |
| 2,382,430 | 8/1945 | London | 24/56 |

FOREIGN PATENTS OR APPLICATIONS

| | | | |
|---|---|---|---|
| 18,229 | 9/1893 | United Kingdom | 24/56 |

*Primary Examiner*—Donald A. Griffin
*Attorney, Agent, or Firm*—Seidel, Gonda & Goldhammer

[57] ABSTRACT

A neck button is provided with a retainer in a manner so that the force applied by tightening a necktie causes a curved portion of the retainer to pivot upwardly and retain the necktie knot in an angled disposition. The retainer projects forwardly of the button and the curved portion of the retainer is concave downwardly beginning in an area adjacent the lower edge of the button.

11 Claims, 6 Drawing Figures

FIG. 1
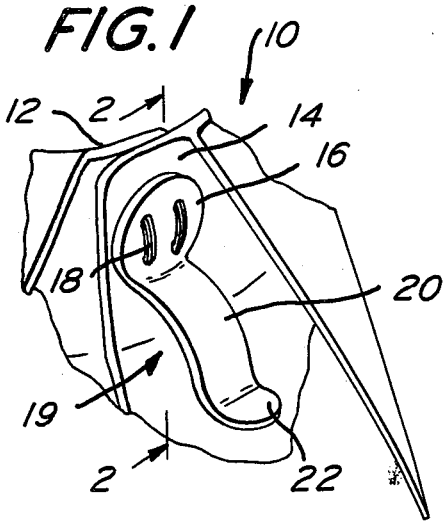
FIG. 2
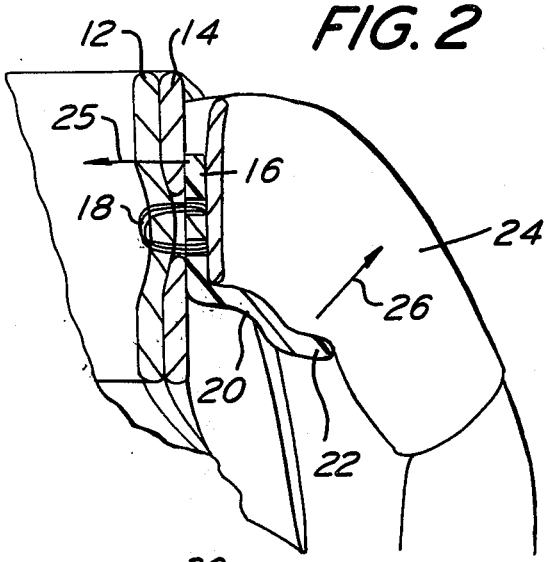
FIG. 3
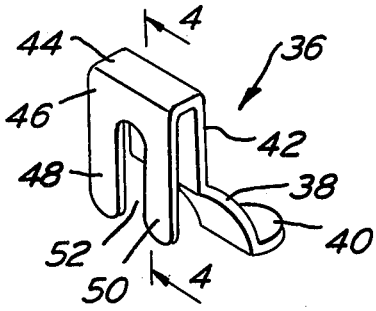
FIG. 4
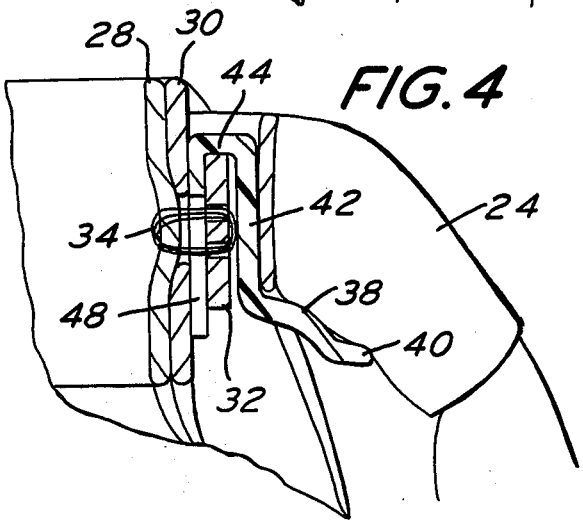
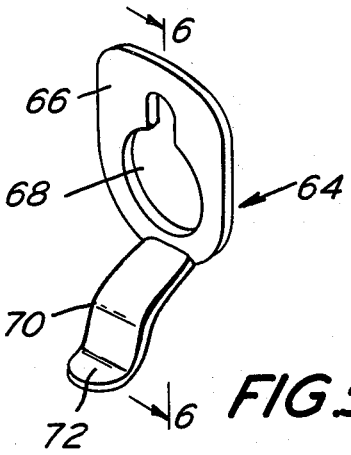
FIG. 5
FIG. 6
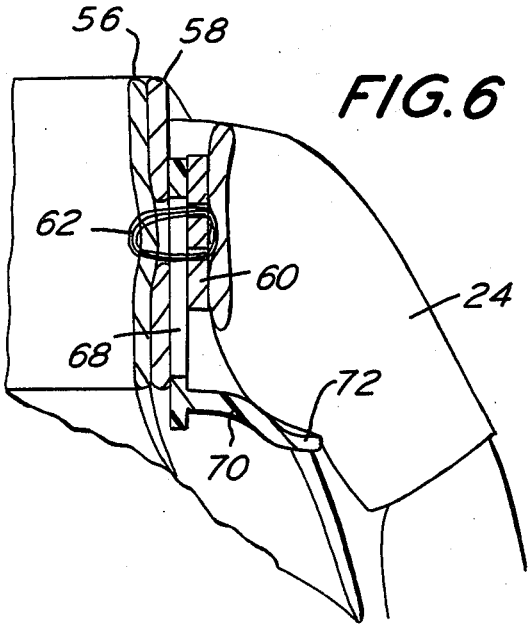

BUTTON AND RETAINER

BACKGROUND OF THE INVENTION

A collar button and retainer have been proposed heretofore. For example, see U.S. Pat. No. 1,984,640 wherein a retainer is integral with a button in the form of a stud whereby the retainer projects from about the middle of the front face of the stud. The stud is not fixedly secured to a collar portion of a shirt. Instead, the retainer has an angled portion which cooperates with the stud to retain the stud in a predetermined position, with the stud being on the inner surface of the collar portion adjacent the wearer's throat. The weight of the necktie below the knot applies a force to the elastic point *c* which causes the stud to contact the throat of the wearer whereby it could become uncomfortable to the wearer.

DISCLOSURE OF THE INVENTION

The present invention is directed to a button and a retainer associated therewith. The button has means thereon for enabling the button to be secured to a portion of a shirt collar so that the button may extend through a button hole in another portion of the shirt collar. The retainer has a curved portion disposed concave downwardly and terminating in a free end. The curved portion projects forwardly from a front face of the button so that the curved portion may pivot upwardly for contact with a necktie as a result of force on the button by tightening of the necktie to its desired position. The upper end of the curved portion is at an elevation below the elevation of the means for enabling the button to be secured to a shirt collar.

It is an object of the present invention to provide a novel button and retainer for application to a shirt collar in a manner which will enable the retainer to pivot upwardly to its desired position as the necktie is tightened to permit the retainer to fully support the knot.

It is another object of the present invention to provide a novel button and retainer which can be used with commercially available conventional shirt collars.

It is another object of the present invention to provide a novel retainer for use with a conventional button on a shirt collar.

Other objects will appear hereinafter.

For the purpose of illustrating the invention, there is shown in the drawings a form which is presently preferred; it being understood, however, that this invention is not limited to the precise arrangements and instrumentalities shown.

FIG. 1 is a partial perspective view of the collar portion of a shirt having the button and the retainer of the present invention.

FIG. 2 is a sectional view taken along the line 2-2 in FIG. 1.

FIG. 3 is a perspective view of a retainer in accordance with another embodiment of the present invention.

FIG. 4 is a sectional view similar to FIG. 2 but showing the retainer in FIG. 3 mounted in association with a conventional button at the collar of a shirt.

FIG. 5 is a perspective view of a retainer in accordance with another embodiment of the present invention.

FIG. 6 is a sectional view similar to FIG. 2 but showing the retainer of FIG. 5 is association with a conventional button at the collar of a shirt.

Referring to the drawing in detail, wherein the like numerals indicate like elements, there is shown in FIG. 1 a button and retainer associated therewith mounted at the collar of a shirt having collar portions 12 and 14. The button and retainer 10 includes a button 16 having an integral one piece retainer 19 connected thereto.

As shown more clearly in FIG. 2, the button 16 is secured to the collar portion 12 by any conventional means such as thread 18. The button 16 extends through a button hole in the collar portion 14 so as to overlie the collar portion 14. As shown, the threads 18 extend through the button hole in collar portion 14.

The button 16 and retainer 19 are an integral one piece structure made from conventional materials used for buttons and may be made from commercially available polymeric plastic materials, may be metallic or any other desired commercially available material. The retainer 19 projects from a bottom edge portion of the button 16 and has a width which may be narrower than the diameter of the button 16. The retainer 19 includes an arcuate portion 20 which is concave downwardly and projects forwardly from a front face of the button 16. The arcuate portion 20 terminates in a rounded toe or tab 22.

The following are exemplary dimensions. Button 16 may have a diameter of about 7/16 of an inch, a thickness of about 1/16 of an inch, and may have either two or four holes through which the thread 18 may extend. The arcuate portion 20 may have a width which is about ¼ inch. The tab 22 lies in a horizontal plane which is about 5/8 of an inch below the lower edge of the button 16. The rounded peripheral surface on the tab 22 projects forwardly from the front face of the button 16 for a distance of about ⅝–¾ inches. Portion 20 has a length of ½ to ¾ inches and a radius of curvature of ⅜ to ⅝ inches.

As shown in FIG. 2, when a necktie 24 is tightened, it imparts a force generally in the direction of arrow 25 to the button 16. The force applied in the direction of arrow 25 causes the curved portion 20 to pivot about the axis of the button hole in collar portion 14 so as to apply a force to the necktie 24 generally along the direction of arrow 26. In this manner, the knot of the necktie 24 is angularly disposed approximately as illustrated in FIG. 2, has a neat appearance, and prevents slippage or any other undesired movement of the knot. Depending upon the size of the knot in the necktie 24, the tab 22 will generally be at the middle or center of the knot.

In FIGS. 3 and 4, there is illustrated another embodiment of the present invention wherein a retainer designated generally as 36 is provided for use with a conventional button 32. In this embodiment, the retainer 36 is discrete with respect to the button 32. Button 32 is secured to the collar portion 28 by any convenient manner such as thread 34. Button 32 is adapted to extend through a conventional button hole in the collar portion 30 so as to overlie the front face thereof.

The retainer 36 includes an arcuate portion 38 terminating in a tab or toe 40 and corresponding to the arcuate portion 20 and tab 22. The retainer 36 includes a front planar body portion 42 connected to a rear planar body portion 46 by a bight portion 44.

The upper end of the arcuate portion 38 is integral with and connected to the front planar body portion 42 approximately at an elevation adjacent to the lower edge of the button 32. The rear body portion 46 is provided with a slot 52 defining legs 48 and 50. When the retainer 36 is applied, it is positioned above the button 32 and slid downwardly so that the threads 34 are received in the slot 52 whereby the button 32 is embraced by the body portions 42 and 46 with the bight portion 44 overlying the upper end of the button 32. When the retainer 36 is associated with the button 32 as illustrated in FIG. 4 and described above, it operates in the same manner as the embodiment shown in FIG. 2. Further, the retainer 36 may be made from the same materials as described above. In this embodiment, the width of the arcuate portion 38 and tab 40 may be equal to the diameter of button 32 or slightly narrower than the diameter of button 32 so as to have substantially the same dimensions as that described above in connection with retainer 19.

In FIGS. 5 and 6, there is illustrated another embodiment of the present invention wherein a retainer 64 is provided and adapted to be associated with a conventional button 60. Button 60 is secured to a collar portion 56 in any convenient manner such as by thread 62. Button 60 is adapted to extend through a buttonhole in the collar portion 58 so as to overlie the front face thereof. The retainer 64 includes a planar body portion 66 having a keyhole slot 68 of sufficient size so that button 60 may extend through the larger diameter portion of the keyhole slot with the neck of the keyhole receiving the thread 62. The retainer 64 includes a forwardly projecting arcuate portion 70 terminating in a toe or tab 72 in the same manner as described above. Retainer 64 may be made from the same materials as described above.

The embodiment shown in FIG. 1 includes a one piece button and retainer. The retainer 19 may be pulled through the buttonhole in collar portion 14 and thereby facilitate the pulling of button 16 through such buttonhole. In the embodiment shown in FIGS. 3, 4 and FIGS. 5, 6 the retainer is separate and discrete from the button. Hence, the retainers 36 and 64 are applied after the button has been caused to move through the buttonhole on its associated collar portion but before the necktie 24 is applied.

Since the throat of the wearer of the shirt is spaced from the button 16, 32 or 60 by the two overlapping layers of the collar portion of the shirt, there is no tendency to cause discomfort as the necktie 24 is tightened. At the same time, such tightening of the knot of the necktie 24 imparts an upward force to the arcuate portions 20, 38 and 70 in a direction corresponding to arrow 26 to properly support the knot 24 in a desired manner which precludes downward or sideways shifting of the knot.

While portions 20, 38 and 70 are preferably arcuate and extend downwardly they may be defined by two angled surfaces so as to be an inverted V-shaped portion.

The present invention may be embodied in other specific forms without departing from the spirit or essential attributes thereof and, accordingly, reference should be made to the appended claims, rather than to the foregoing specification as indicating the scope of the invention.

We claim:

1. An article of manufacture comprising a button and a retainer associated therewith, said button having means thereon for enabling the button to be secured to a portion of a shirt collar so that the button may extend through a buttonhole in another portion of the shirt collar, said retainer having a portion angled downwardly and terminating in a free end, said retainer portion projecting forwardly from a front face of the button so that said portion may be pivoted upwardly for contact with a necktie as a result of force on the button by tightening of the necktie, and said means for enabling said button to be secured to a portion of a shirt collar being at an elevation above the elevation of the upper end of said retainer portion, said downwardly extending retainer portion being curved so as to be concave downwardly.

2. An article in accordance with claim 1 wherein said arcuate portion is integral and one piece with the button adjacent the lower edge of said button.

3. An article in accordance with claim 1 wherein said retainer is discrete with respect to said button and has a body portion in contact with a rear face of said button, said retainer body portion having an opening through which threads may extend to facilitate securement of the button to a collar portion of a shirt.

4. An article in accordance with claim 3 wherein said retainer rear body portion is connected to a retainer front body portion by a bight portion, said retainer curved portion extending from and being integral in one piece with said retainer front body portion.

5. An article of manufacture comprising a button and a retainer associated therewith, said button having at least two holes for facilitating securement of the button to a collar by use of thread in a manner so that the button may extend through a button hole in a portion of a collar, said retainer having a downwardly extending portion projecting forwardly from a front face of the button and terminating in a tab, said tab and button lying in generally mutually perpendicular planes, and the upper end of said downwardly extending portion of the retainer being below the elevation of the holes in said button, said retainer being integral in one piece with said button, said downwardly extending portion being connected at its upper end to a lower edge portion of said button.

6. An article in accordance with claim 5 wherein said retainer having a width which is narrower than the diameter of said button.

7. An article in accordance with claim 5 wherein said retainer is discrete with respect to said button, said retainer having a body portion which is planar and juxtaposed to a rear face of said button.

8. An article in accordance with claim 5 wherein said downwardly extending portion of said retainer is concave downwardly, said tab being rounded at its free end.

9. An article in accordance with claim 8 wherein said arcuate portion has a length of about ½–¾ of an inch and a radius of curvature of ⅜–⅝ inches.

10. An article in accordance with claim 5 wherein said downwardly extending portion is substantially wider than its thickness for supporting a necktie without slippage of the necktie.

11. An article of manufacture adapted to be supported by a collar for contact with a necktie knot comprising a vertically disposed portion having an opening to facilitate being supported at a portion of a collar, a downwardly extending portion projecting forwardly from a front face of said vertically disposed portion and terminating in a tab, said tab and vertically disposed portion lying in generally mutually perpendicular planes, said downwardly extending portion being concave downwardly, and said tab being rounded at its free end.

* * * * *